US005741033A

United States Patent [19]

Everett

[11] Patent Number: 5,741,033

[45] Date of Patent: Apr. 21, 1998

[54] SECURITY OPERATING DEVICE

[76] Inventor: James D. Everett, 1131 Bull Run, Richardson, Tex. 75080

[21] Appl. No.: 705,018

[22] Filed: Aug. 29, 1996

Related U.S. Application Data

[63] Continuation of Ser. No. 172,583, Dec. 23, 1993, abandoned.

[51] Int. Cl.[6] ..... E05C 19/18

[52] U.S. Cl. ..... 292/289; 292/259 R; 70/94

[58] Field of Search ..... 70/94, 416, 417, 70/429, 431; 292/259 R, 260, 288, 289, 297, 298, 338, 339

[56] References Cited

U.S. PATENT DOCUMENTS

| | | | |
|---|---|---|---|
| 313,942 | 3/1885 | Knauer | 292/259 |
| 521,870 | 6/1894 | Smith | 292/259 |
| 598,405 | 2/1898 | Williams | 292/339 |
| 843,527 | 2/1907 | Fuchs | 70/94 |
| 963,527 | 7/1910 | Dessauer et al. | 70/94 |
| 977,182 | 11/1910 | Fuchs | 70/94 |
| 977,184 | 11/1910 | Fuchs | 70/94 |
| 1,054,151 | 2/1913 | Troetel | 70/94 X |
| 1,163,478 | 12/1915 | Snow | 292/229 |
| 1,943,826 | 1/1934 | Holtzman | 70/94 |
| 2,421,275 | 2/1947 | Lopez | 292/259 |
| 3,111,340 | 11/1963 | Spencer | 292/229 |
| 3,527,068 | 9/1970 | Gervis et al. | 70/94 |
| 3,527,069 | 9/1970 | Tumbiolo | 70/114 |
| 3,719,821 | 3/1973 | Foreman | 70/431 X |
| 3,792,885 | 2/1974 | Giordina | 292/39 |
| 3,806,179 | 4/1974 | Roessle | 292/259 |
| 4,004,833 | 1/1977 | Hull | 292/288 |
| 4,213,315 | 7/1980 | Lewis | 70/94 |
| 4,238,943 | 12/1980 | Betkouski | 70/416 |
| 4,779,910 | 10/1988 | Dameron | 292/259 R |
| 5,010,747 | 4/1991 | Norden, Jr. | 70/94 |
| 5,098,142 | 3/1992 | Fontenot | 292/292 |
| 5,165,741 | 11/1992 | Everett | 292/259 R |

FOREIGN PATENT DOCUMENTS

| | | | |
|---|---|---|---|
| 6802 | 1/1907 | France | 292/259 R |
| 376052 | 5/1907 | France | 292/259 R |
| 2554495 | 5/1985 | France | 292/259 R |
| 329455 | 11/1920 | Germany | 292/259 R |
| 262120 | 1/1929 | Italy | 292/259 R |
| 611795 | 11/1948 | United Kingdom | 70/94 |

*Primary Examiner*—Suzanne Dino

[57] ABSTRACT

A security operating device which mechanically connects a standard door knob to an added security device which may be used to prevent intrusion against that door. The security operating device converts the rotational motion of the door knob to lifting, pulling, or pushing motions which engage or disengage the additional security device. The internal lock in the door knob lock set is thereby also used to lock the added security device.

15 Claims, 11 Drawing Sheets

SECURITY OPERATING DEVICE

This application is a continuation of application Ser. No. 08/172,583, filed Dec. 23, 1993, now abandoned.

This invention relates to operating devices for mechanical security devices which prevent forcible opening by intruders. In particular this invention relates to a security operating device which attaches to a door knob lock set.

DESCRIPTION OF PRIOR ART

As our societies have become more violent and permissive of criminals, many products have been developed to improve the security of the doors of our residences and businesses. These products are typically bars which extend across the width of the door opening. For example the patent issued to Everett, U.S. Pat. No. 5,165,741 (1992) describes a bar fastened at both sides of a door using screw hooks. This device, while providing great advantage for personal security when one is indoors, cannot be operated from outside the residence or business.

Other auxiliary latching devices suffer also from the inability to operate them from the outside. For example, a patent issued to Fontenot, U.S. Pat. No. 5,098,142 (1991) describes a drop plate mechanism which restrains the opening of a door by inserting a slotted plate over the cylindrical part of a restraining plate attached to the door jamb. These devices may protect an occupied building or residence but are deficient in that one door must be left unprotected when the building is unoccupied.

To improve this situation devices have been developed to operate certain internal systems which employ a key lock set installed through the door. Dessauer & Baruch, U.S. Pat. No. 963,527 (1910) describe a device of this type to lift a floor brace. The patent issued to Lewis, U.S. Pat. No. 4,213,315 (1980) discloses a similar device for lifting a hinged friction type door brace.

These operating devices suffer from a number of deficiencies:

(a) They require that a separate hole be drilled through the door. From a product view this deters a home owner who is concerned with ruining the door by a mistake in drilling. Renters or apartment residents cannot usually obtain permission to drill holes in doors.

(b) An additional key is required to operate the added device resulting in a greater amount of time being required for the resident to reach the safety of their home.

(c) The key which allows access to the device is also used as the means to transfer energy from the operator's hand to engage or disengage the security device. This results in broken keys and therefore, lack of access.

(d) Adding additional lock sets to the outside of the door detracts from the appearance of the property.

OBJECTS AND ADVANTAGES

It is accordingly an object of the present invention to provide a security operating device which will:

(a) Allow for quick entry so that the occupant may reach the safety of his home or business as soon as possible.

(b) Provide a reliable means to transfer energy from the entrant's hand to the security device to be engaged or disengaged.

(c) Provide a means to disengage the security operating device from the mechanical security device when the occupant is inside. This will prevent an intruder with a pass key from entering when the building is occupied.

(d) Be installed without requiring the disassembly of the door knob lock set.

(e) Be installed without modification of the existing door, in that landlords do not typically allow modifications.

(f) Hold the security device in an operable position such that it is not necessary to handle the device to engage or disengage.

(g) Be unobtrusive as to not detract from the appearance or the appeal of the property.

BRIEF DESCRIPTION OF THE DRAWINGS

Some of the objects have been stated, others will appear in the description proceeds when taken in connection with the accompanying drawings, in which.

Reference Numbers on Drawings 10 door

Figure 1:
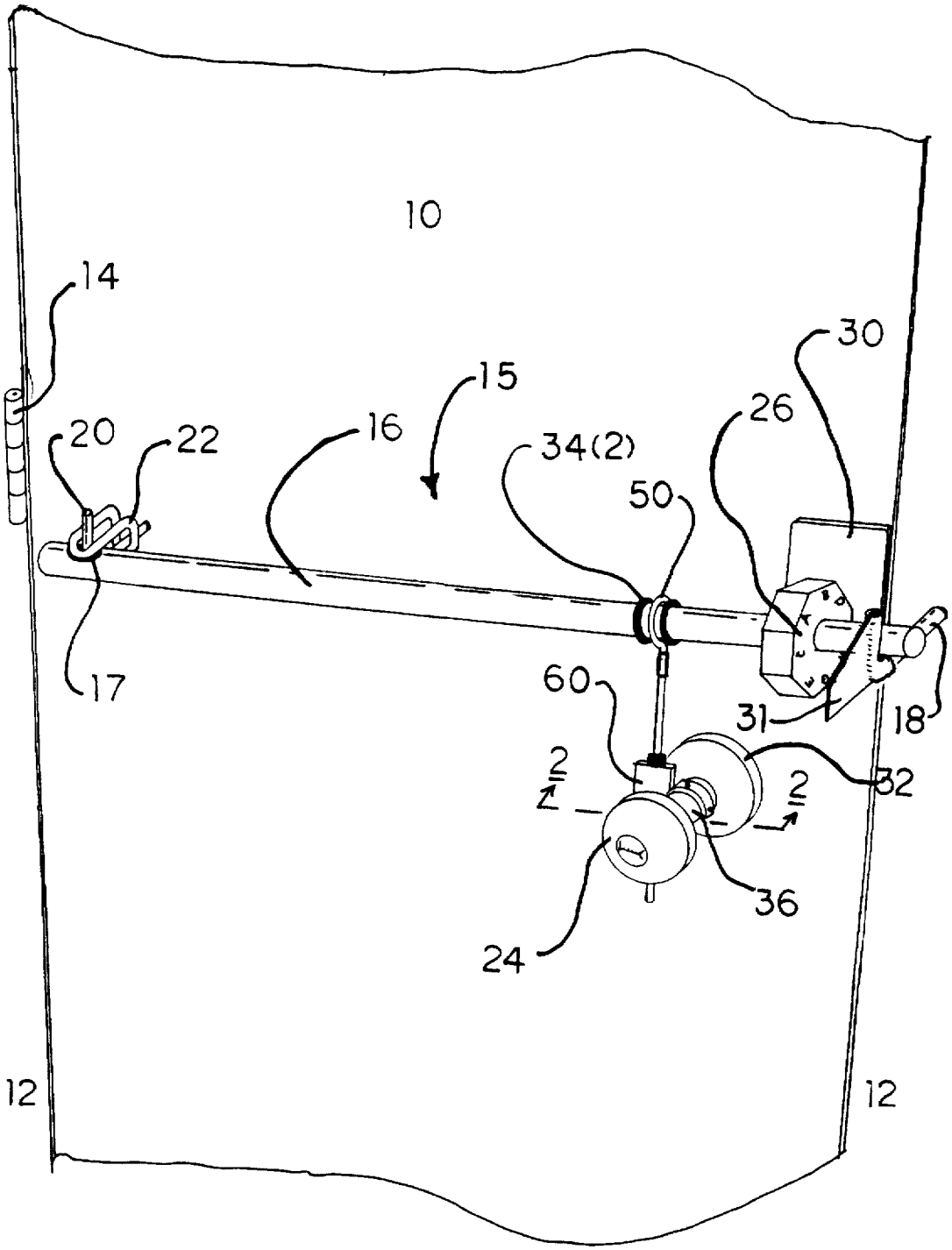
FIG. 1 is a fragmentary perspective view illustrating a security operating device 60 embodying the features of the present invention which facilitate the operation of a generic cross bar security device.

12 wall
13 flour
14 hinges
15 auxiliary latching mechanism
16 cross bar
17 hole in cross bar
18 screw hook (major)
20 screw hook (minor)
22 locking link
24 doorknob
26 octagon block
28 hole in octagon block

29 octagon block faces

30 pressure plate

31 inclining ramp

32 doorknob lock set mounting plate cover

34 rubber washers

36 doorknob shank

38 collar

39 crescent portion of collar 38

40 cam block which receives shaft

41 opening in collar 38

42 tube which receives shaft—alternative embodiment of cam block 40

44 weld joint

46 actuator shaft

48 shaft collars

49 connector

50 engaging ring for cross bar

51 shank end of engaging ring 50

52 engaging ring adapter

53 end of shaft adapter 54

54 shaft adapter

55 end of actuator shaft 46

56 set screws a, b, and c

58 hole in shaft to attach devices other than cross bars

60 operating device assembly—ref. numbers 38–58 except 42

62 operating device assembly—ref. numbers 38–58 except 40 and 50–54

64 chain to disengage drop plate embodiment

66 drop plate

67 drop plate channel

68 retainer plate

70 screws to attach retainer plate to wall

72 chain to engage drop bolt

74 drop bolt

76 eye bolts

78 hole in floor to receive drop bolt

DESCRIPTION—FIGS. 1–9, 11

FIG. 1 illustrates a conventional inward opening door 10 with standard doorknob 24, mounted by hinges 14 into wall 12. An auxiliary latching mechanism is provided. In the embodiment shown in FIG. 1, auxiliary latching mechanism 15 includes a cross bar 16 or bar with an oversized hole 17 through an end of the bar and perpendicular to the length of the bar, which hole 17 is preferably oversized for being received over minor screw hook 20 on the hinge side of the door (minor screw hook may be mounted either in door 10 or wall 12 depending on user preference in the particular application). Locking link 22 is engaged over minor screw hook 20 to hold that end of the bar in place. An engaging ring 50 is loosely received over the other end of the bar and held in a captive position by two friction fitting flexible rubber or plastic washers 34 or the like received over the bar.

Figure 4:
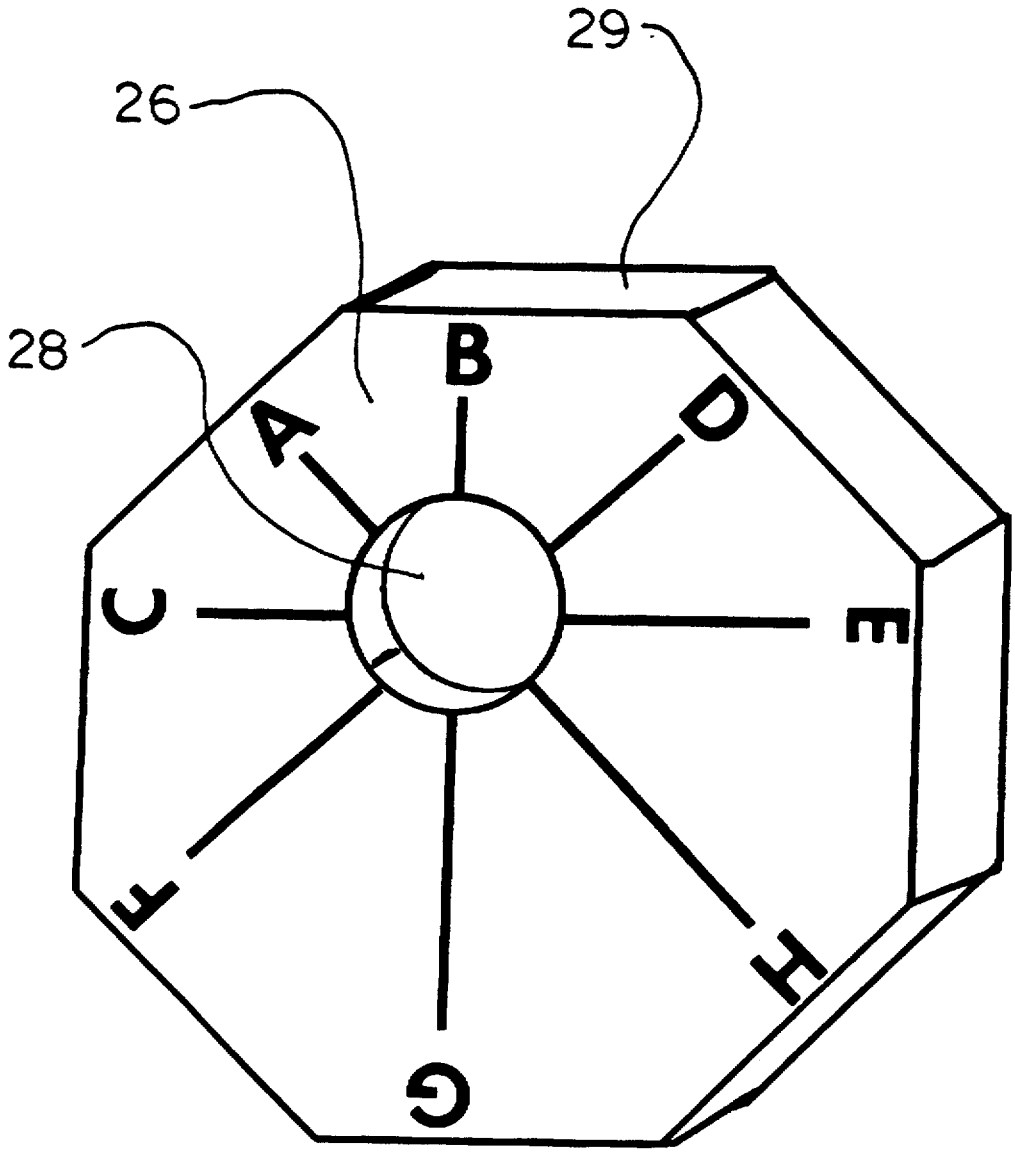
FIG. 4 is a perspective view of octagon block 26.

An octagon block 26 (detailed in FIG. 4) is tightly received over this end of the bar by means of hole 28 positioned such that the distances from the center of the hole to each face 29 of the octagon, marked 'A' through 'H' are different, 'A' being the shortest distance and 'H' being the longest distance. The tight fit of the octagon allows positioning of the octagon on the bar and rotation around the bar. Pressure plate 30 is attached to the door at the door edge by a means, such as glue, to underlie the octagon block 26. The door knob end of the bar being laid across and in close proximity to the door into a "cradle" formed by the upwardly pointing major screw hook 18 (which is mounted into wall 12) and the wall and extending slightly beyond the major screw hook.

Figure 11:
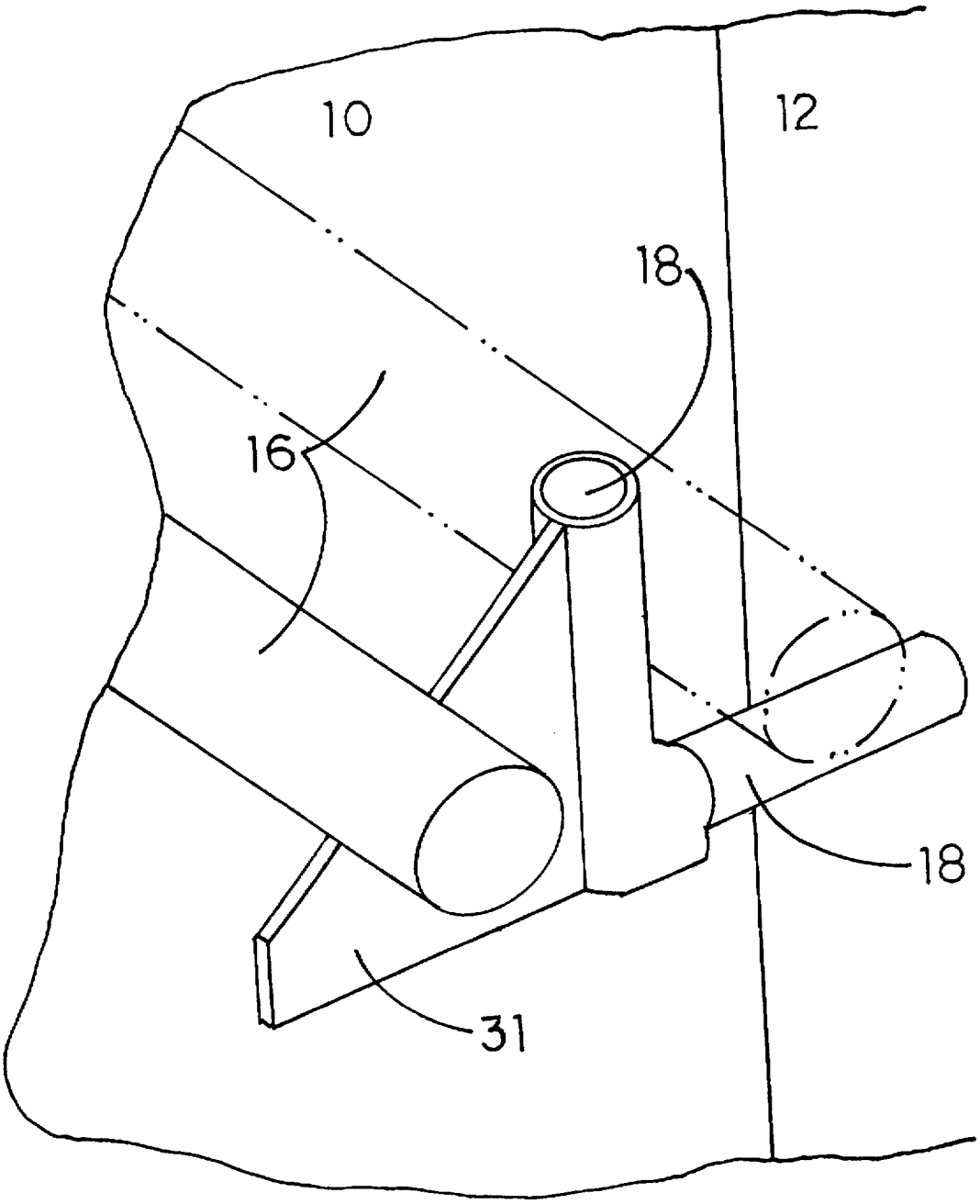
FIG. 11 is a fragmented perspective view of inclining ramp 31 received over the major screw hook 18 and illustrating movement of the cross bar upon impingement on the inclining ramp.

Inclining ramp 31 is received over the major screw hook to allow cross bar 16 to incline up and over the end of the major screw hook and thereby drop into the cradle formed by wall 12 and the major screw hook as the door is being closed without the knob being rotated to lift the bar over the screw hook. The inclining ramp can be made of plastic or metal or such and there are many means to attach it to the screw hook. (Detail of the incline ramp is shown in FIG. 11.) While the specific type of latching mechanism or even the specific type of cross bar and associated securing hardware are not of particular importance, one type of latching mechanism 15 which includes a bar 16 is shown in some detail in various embodiments to facilitate describing the present invention. For example with simple hardware changes the cross-bar could be a sliding bar as opposed to the lifting bar which is shown.

Operating device assembly 60 is secured around the knob shank 36 by a means and aligned not to interfere with knob lock set mounting plate cover 32. In the embodiment shown in FIG. 1, the security operating device 60 includes a collar 38 (details shown in FIGS. 2 and 3), which is secured around an existing knob shank 36. An actuating shaft 46 is adjustably attached to collar 38. A latch engaging connector, generally designated 49, comprising specific alternative embodiments such as a ring 50, engages between the latching mechanism 15 and the actuating shaft 46. For example, ring 50, is received over cross bar 16 and a shank end 51 of the ring is inserted into one end of a shaft adapter 54. Shaft adapter 54 may be permanently fixed to either shank end 51 (as shown) or to shaft end 55 (not shown). The other end of the shaft adapter is detachably received over an outwardly extending end 55 of actuating shaft 46 (as shown) or over shank end 51 (not shown).

Figure 2:
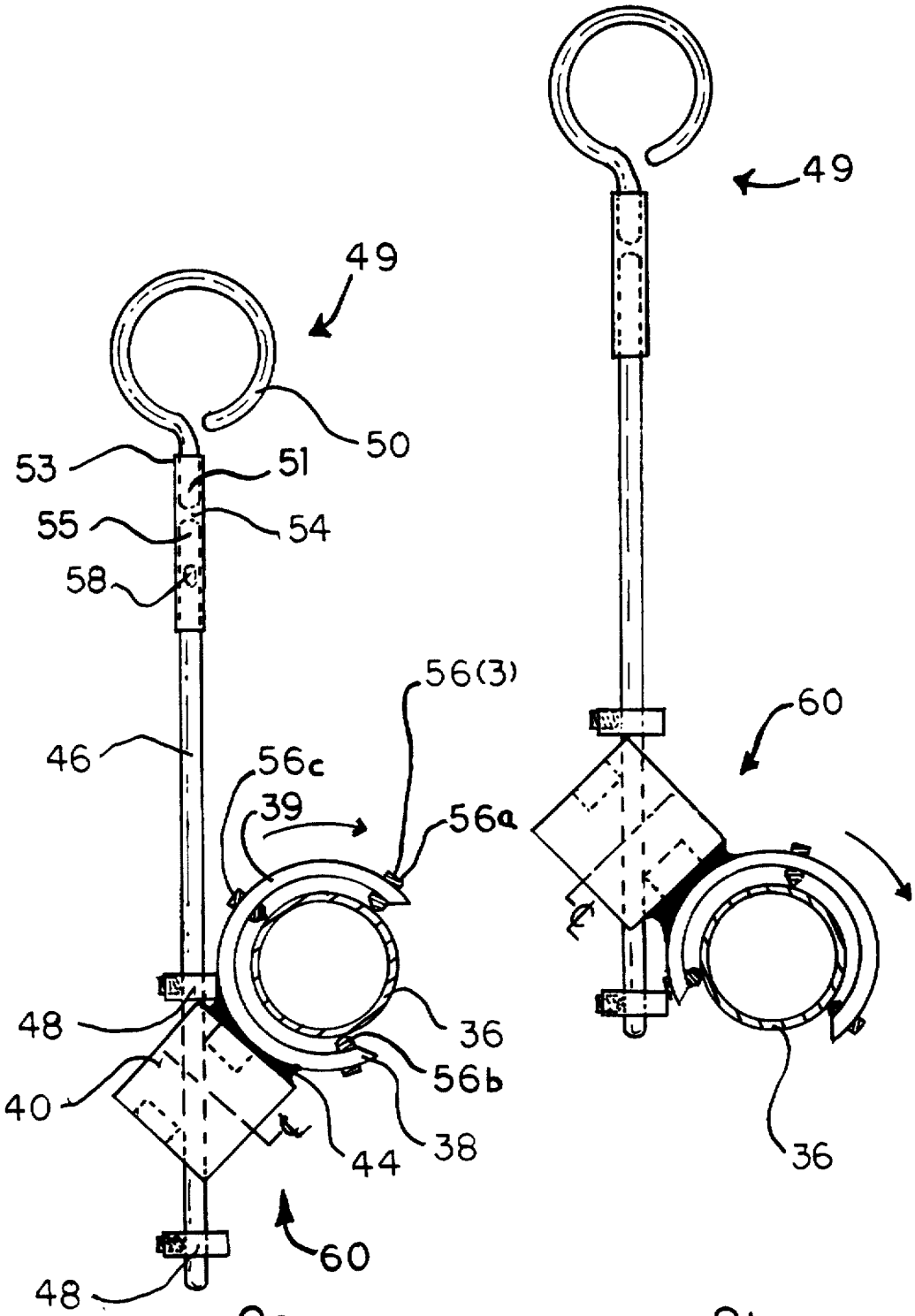
FIG. 2 is a sectional front view taken along the line 2—2 of FIG. 1 showing a means for attaching the security operating device assembly 60 to a door knob and also showing operating positions 2*a* and 2*b*.
Figure 3:
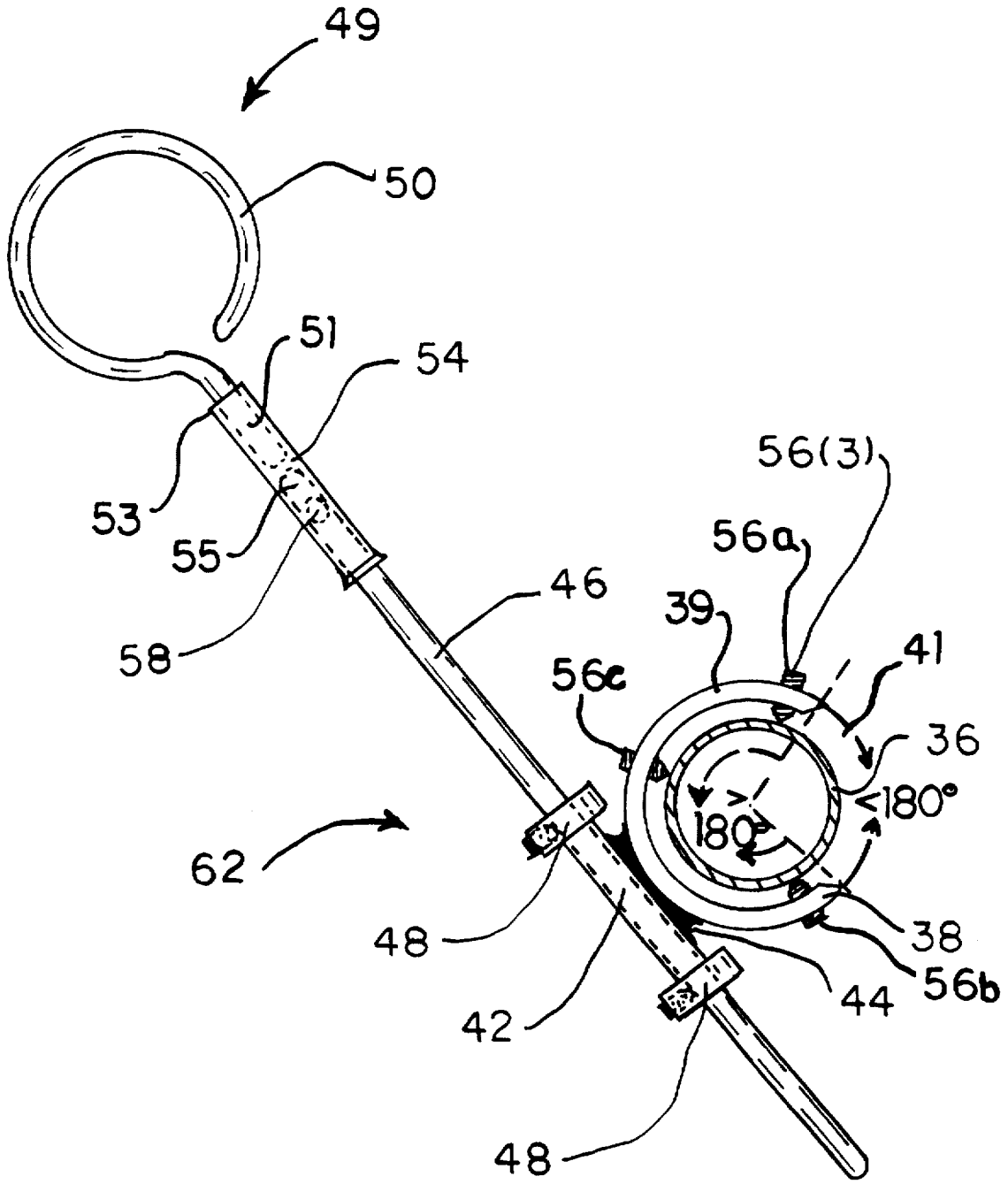
FIG. 3 is a sectional front view taken along the line 2—2 of FIG. 1 showing security operating device assembly 62, an alternative embodiment of a means for attaching the security operating device, including a tube which receives the actuating arm.

FIGS. 2*a* and 2*b* illustrate a collar 38, having a crescent-shaped portion 39 and having an open portion 41 which is sized to be received over a standard doorknob shank 36 without removing the doorknob 24. Preferably, the crescent collar portion 39 is more than 180° and the open portion is less than 180° degrees. (FIG. 3 shows this detail). An opening 41 of about 90° to 120° is preferred. The collar 38 is secured to the shank 36, as with three set screws 56, which are screwed into drilled and tapped holes in the collar perpendicular from and extending toward the axial centerline of the collar 38 and of coaxial knob shank 36. Two of the set screws, first and second screws 56*a* and 56*b*, are located at the opposite end points of the crescent-shaped portion of collar 38 and a third set screw 56*c* is located at an angle of generally 90 degrees around the circumference of the collar from one of the first two set screws 56*a* or 56*b*.

Actuating shaft 46 is connected to collar 38 for arcuate movement with collar 38 turning doorknob 24 and knob shank 36. Preferably, the length of shaft 46 from upper shaft collar 48 to outward end 55 can be adjusted during attachment so that various latching mechanisms can be accommodated and efficiently operated with security operating device 60. In the embodiment shown in FIGS. 1, 2*a*, and 2*b*, a cam block 40 is rigidly attached to the collar 38 at a point about midway between the set screws 56*b* and 56*c* which are the greatest distance apart on the collar. This arrangement maximizes the leverage of screws 56 while allowing access to all of them for tightening. The means 44 for rigid attachment of the collar 38 to cam block 40 is not of great consequence and will depend on the particular application; however, a preferred attachment means for this embodiment is weld joint 44 as shown in FIGS. 2 and 3. Shaft 46 is slidably received through cam block 40 and is held in position by shaft collars 48 which are sized for movement along shaft 46 and which are equipped with set screws to tighten against the shaft 46 to hold the shaft at a selected position with the cam block held therebetween. Thus, by selectably positioning shaft collars 48, the length of the outward extension of shaft 46 is adjustable.

Figure 5:
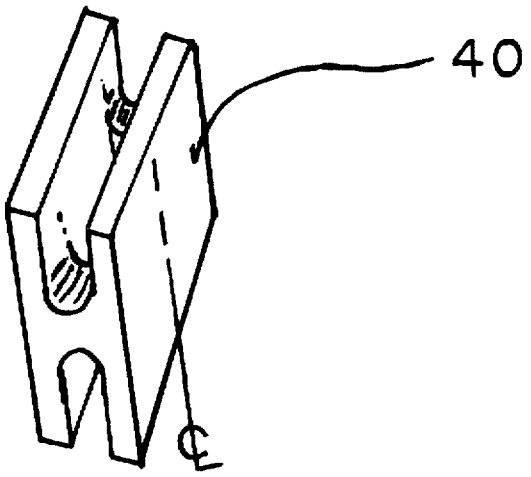
FIG. 5 is a perspective view of cam block 40.

Preferably, as shown in FIGS. 1, 2, and 5, the cam block 40 is designed such that it may be rotated at least 90 degrees before rotational motion is imposed on the shaft end 55. (This is shown in particular in FIG. 2 in the orientation of the center line between FIGS. 2*a* and 2*b*) This allows operation on all known available door knob lock sets which operate between 40° and 90° of rotation. Changing the dimensions of cam block 40 can increase the angle through which the cam block can rotate before angular rotation of the shaft occurs. Also, if required, moving the shaft collars closer to the cam block can decrease this rotation angle. It may approach 0° if the shaft collars are positioned snugly against the cam block.

The opening in cam block 40 is better detailed in FIG. 5 and is slightly larger in width than the diameter of shaft 46 to allow pivoting of the shaft in a plane parallel to the door. The depth of the cam block along the center line in combination with the narrow opening restricts the motion of the shaft end in planes perpendicular to the plane of the door thus holding the shaft end close to the door surface.

An alternative embodiment is shown in FIG. 3, wherein shaft 46 is connected to collar 38 with a tube 42 which fits closely over the shaft and will produce a rotational motion at the ends of the shaft which directly follows the rotation of doorknob 24 and replaces cam block 40 which fits loosely over shaft 46. Tube 42, which is simpler in design, operates well with doorknobs with small angles of rotation.

Using either of the above embodiments, a shaft adapter 54 with an engaging ring 50 is received over an upwardly directed, outwardly extending shaft end 55 to lift or lower one end of cross bar 16 into or out of latching engagement with major screw hook 18.

When a tube 42 is used, a sliding cam action is provided to cross bar 16 through ring 40 on actuator shaft 38. Thus, when knob 24 is turned, the knob shank 36, being rigidly connected to knob 24 (or formed as part of the knob), will rotate. This rotates collar 38 and tube 42, thus moving shaft 46 in an arcuate path, a portion of which will impart a vertical force to an auxiliary latching mechanism 15, such as to cross bar 16 which is more clearly illustrated in FIG. 9. When a cam block 40 is used, most of the non-vertical portion of the rotated operating device is accommodated within the cam block itself. Primarily only vertical motion is imparted to the actuating shaft as indicated more clearly in FIG. 8.

With cross bar in place in ring 50, knob 24 is rotated to allow the user to exit. On the outside the user turns the knob to raise the mechanism, pulls the door closed, and releases the knob or rotates it closed if necessary to engage both the standard doorknob bolt and the auxiliary latch mechanism 15. The doorknob is locked with a key so that it cannot rotate. If inclining ramp 31 is used, the door is simply locked inside and pulled closed after exiting. Even if the bolt is pried open as with a knife or credit card, the auxiliary latch remains securely locked in place. A credit card, pushing in the knob bolt, will not allow the knob to be rotated. The only way to re-enter the door is to unlock the knob with a key and then turn the knob. Rotation of the knob disengages the auxiliary latch. No unnecessary force is placed on the key and the leverage of the knob is greater than the key so that operation of the auxiliary latch is facilitated through the knob.

Figure 6:
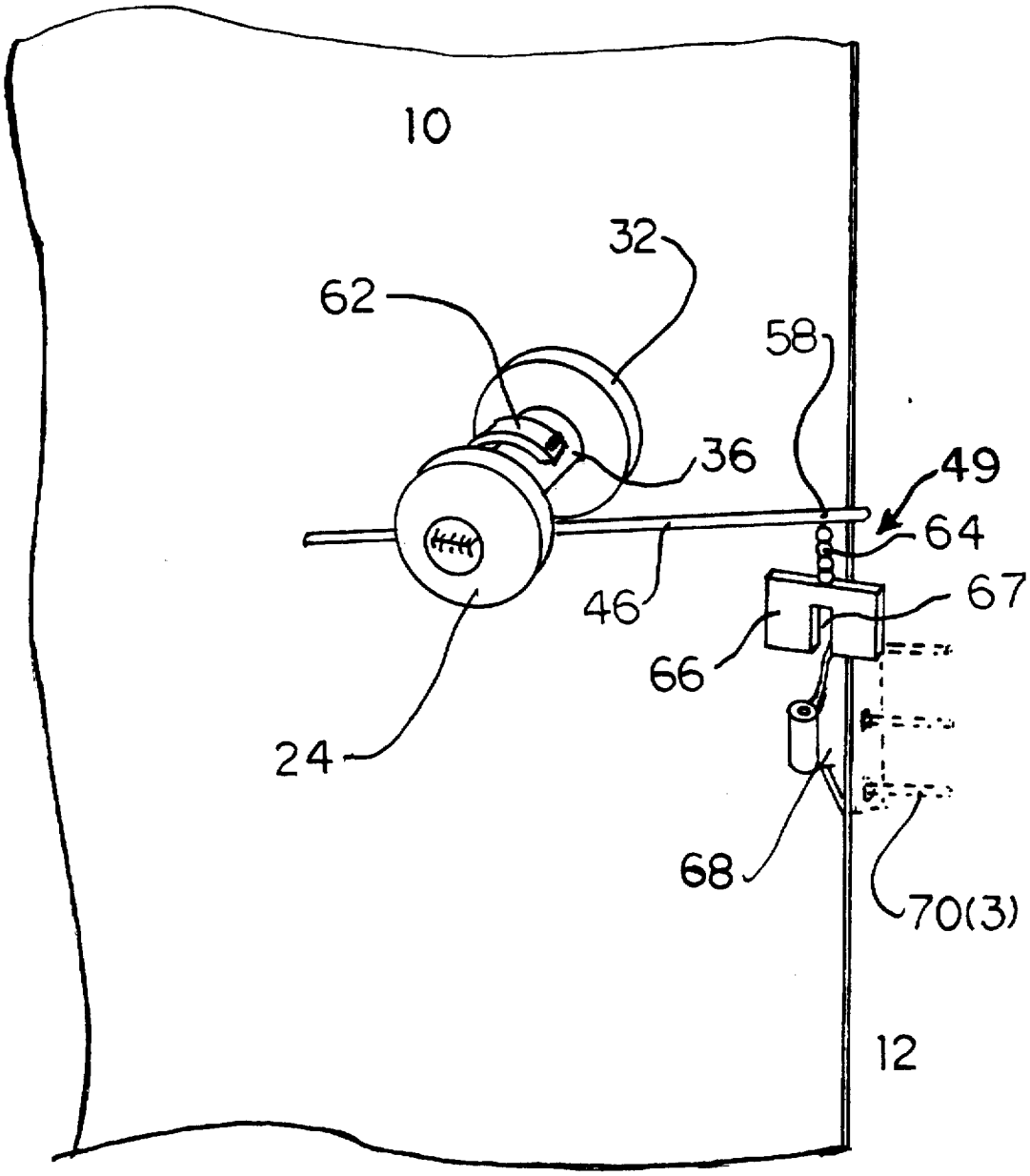
FIG. 6 is a fragmentary perspective view illustrating operating device assembly 62, which is an alternative embodiment of operating device assembly 60, engaging a drop plate security device.

FIG. 6 illustrates another alternative embodiment of a security operating device operating a drop plate security device. A sectional view of door 10 with knob shank 36 and installed operating device assembly 62 is shown. For this application engaging ring 50 and ring adapter 54 are not used. Rather, connector 49 in this embodiment comprises a chain 64 attached to a hole 58 in the shaft 46 by a means and drop plate 66 is attached to the other end of the chain 64 also by a means. Retaining plate 68 is attached to wall 12, as by screws 70. Shaft 46 is adjusted by placing and fixing shaft collars 48 (shown in FIG. 3) such that drop plate 67 will be received over the retainer plate when the door is closed and knob 24 is allowed to return to the engaged position. In this position, the door would impact a side of the drop plate with the other side of the drop plate impacting the wall thus prohibiting the opening of the door by force. Installation of this embodiment of the security operating device is the same as for the cross bar application, except for the orientation of the collar, such that the shaft 46 is properly oriented.

Figure 7:
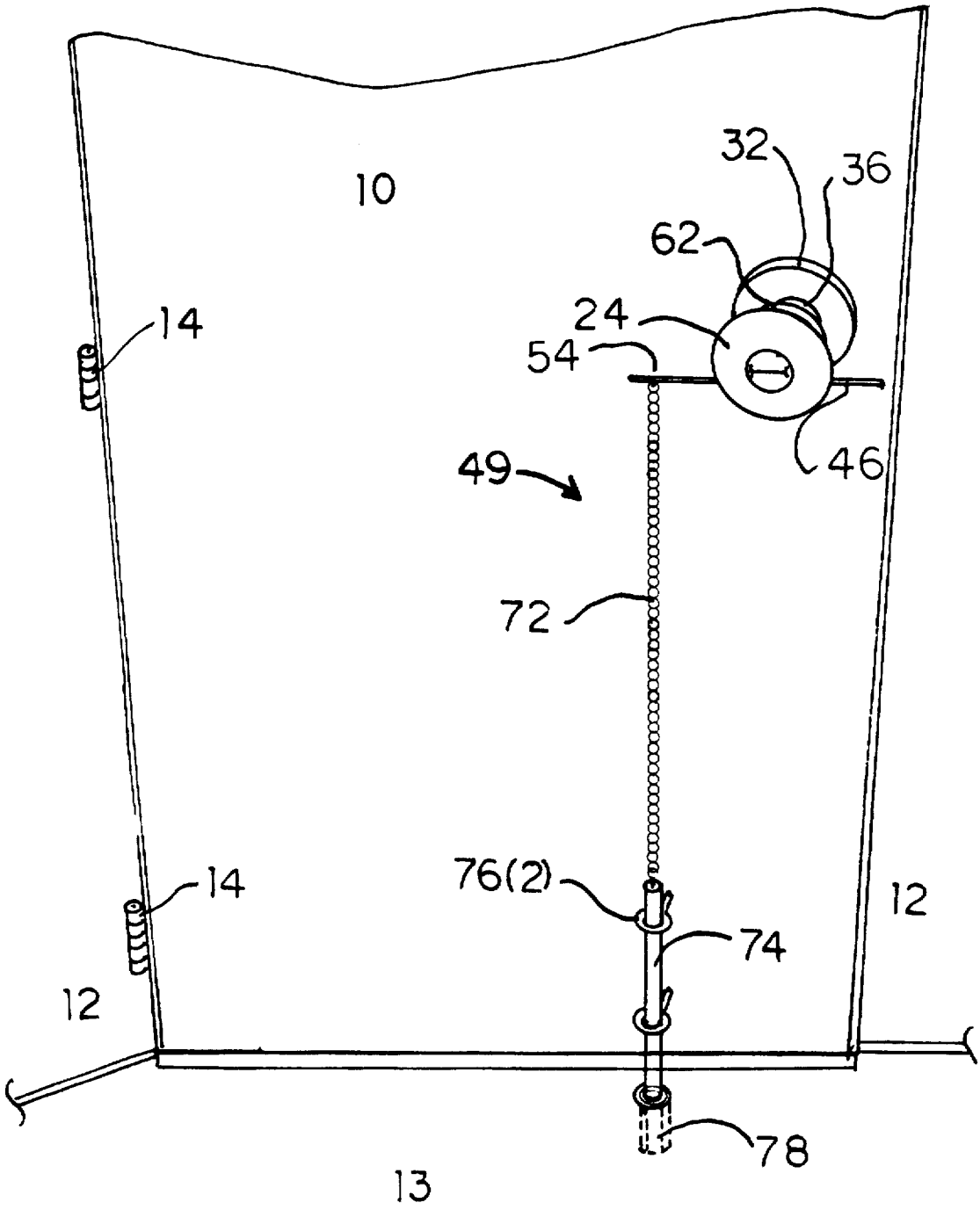
FIG. 7 is a fragmentary perspective view illustrating operating device assembly 62, which is an alternative embodiment of operating device assembly 60, engaging a drop bolt security device.

FIG. 7 illustrates another alternative embodiment of the security operating device 62 operating a drop bolt system such that door 10, which is mounted in wall 12 by hinges 14 is prevented from opening by drop bolt 74. Security operating device 62 is installed on knob shank 36 with a connector 49, in this embodiment a chain 72, being attached to hole 58 in shaft 46 by a means and the other end of the chain being attached to drop bolt 74 also by a means. Drop bolt 74 is received through two eye bolts 76 which are screwed into the door. Operating device 62 is adjusted by set screws 56 (shown in FIG. 3) such that shaft 46 is generally parallel to floor 13 and shaft collars 48 are positioned such that hole 54 is generally above drop bolt 74. With doorknob 24 in a static closed door position, the drop bolt is received into hole 78 which has been drilled into the floor. This configuration prevents the door from being forced open unless the doorknob is unlocked, such that the knob can be rotated, thus lifting the drop bolt and disengaging it from the hole in the floor. Installation is accomplished as in the cross bar application, except as above stated.

The security operating device 60 is installed such that when knob 24 is turned, the knob shank 36, being part of the knob, will rotate thus rotating device 60 and moving shaft 46 which will impart upward force to cross bar 16. Installation of the device for operating a cross bar is advantageously accomplished by sliding the open side of the crescent shaped collar 38 over the shank of the door knob, rotating the device such that cam block 40 is on the door hinge side of the neck and toward the bottom of the door. The knob, being spring stabilized in a latching position is used to orient the device. Typically doorknobs sold today require rotation of between 40 and 85 degrees. In this range the device should be oriented as in FIG. 2*a* such that the knob cannot be rotated in a counter clockwise direction. In this case the centerline of the cam block should generally be at a 45 degree angle as shown in FIG. 2*a*. When the knob is in a rest position, the set screws are tightened equally to firmly lock the collar to the shank.

Rubber washer 34, which limits the movement along the bar of the engaging ring, is snugly received over the bar.

Next the engaging ring is received over the bar followed by another rubber washer. These three parts are moved together on the bar to a point generally over the center of the cam block so that the motion of the shaft is basically up and down. This may be adjusted so that the shaft is at an angle to the edge of the door to reduce the upward travel of the engaging ring if desired. Shaft collars 48 are loosened so that the shaft can be extended upward to engage the shaft adapter. With the shaft fully inserted into the shaft adapter, the shaft collar on top of the cam block is reversibly fixed with a set screw. The lower shaft collar is reversibly fixed on the shaft at a position which will not interfere with normal operation and is used to prevent the shaft from pulling out of the cam block when the bar is lifted to disengage the shaft from the shaft adapter. The center set screw 56 on the collar may be loosened such that the center of the crescent shaped collar can be pushed toward or pulled away from the door. This moves the tip of the shaft closer or further away from the door providing inward and outward adjustment of connector 49 from the surface of the door as needed. Inclining ramp 31 is received over the major screw hook when desired. Installation of the operating device assembly 62 is the same as for operating device assembly 60 except that it can only operate rotationally unless other parts are added. The security operation device may be installed on the opposite side of the knob depending on preference of the user.

From the description above, a number of advantages of my security operating device become evident:

(a) The device can be installed without removing the door knob.

(b) The device may be disengaged from the knob 24 by simply sliding the shaft adapter off the shaft and thus removing the possibility of an intruder using a second key to enter.

(c) It allows an additional security device to be operated without drilling more holes in the door.

(d) The device does not require an additional key operation which would slow entry to a safe haven.

(e) The device does not impart force through a key but instead uses the existing knob to impart force to the security device. This being more reliable.

(f) It is unobtrusive in the exterior view of the property.

(g) The operating device will hold the security device in an operational position thus not requiring that the operator handle the security device mechanism.

OPERATION FIGS.—1, 8–10

Figure 8:
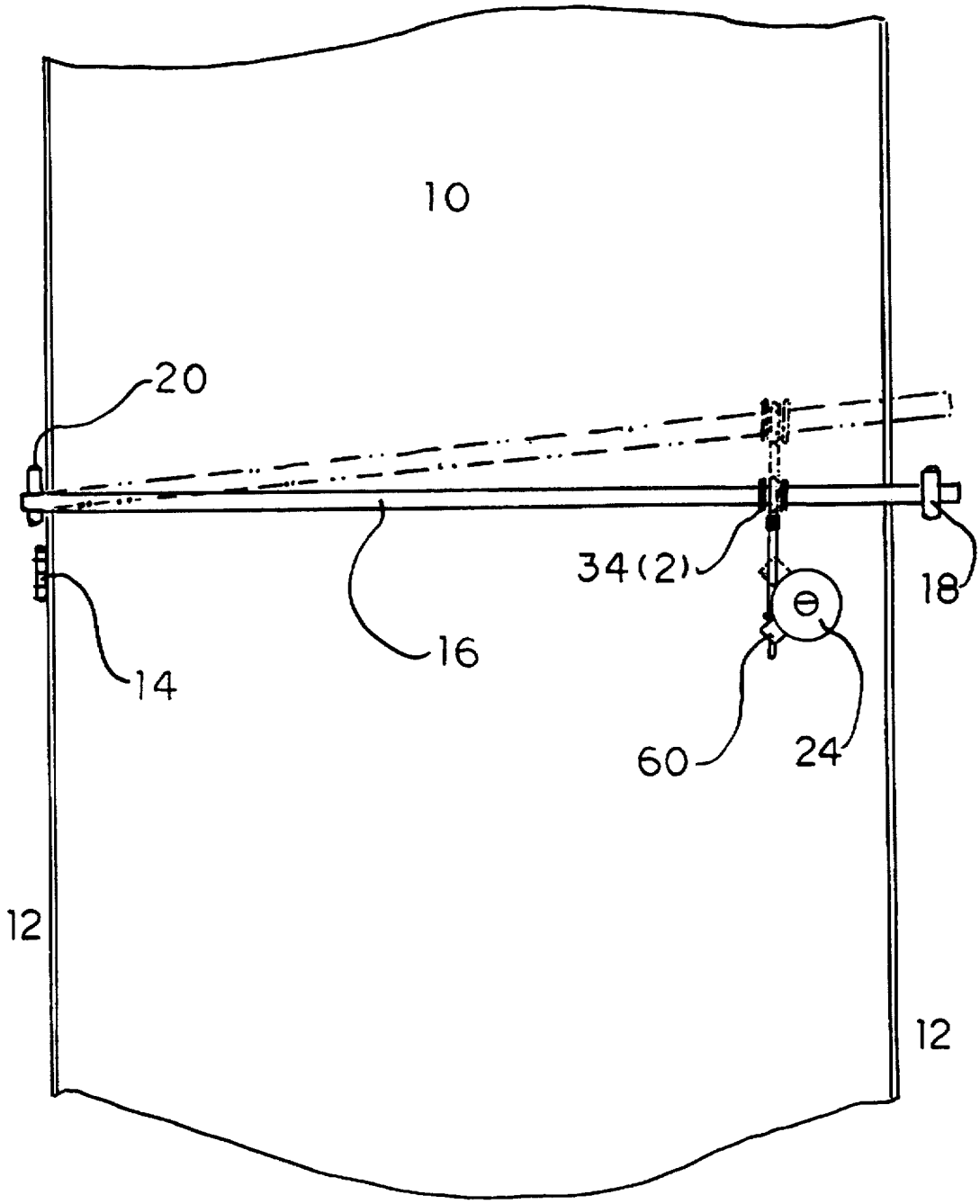
FIG. 8 shows a front operational view of the security operating device disengaging a cross bar.
Figure 9:
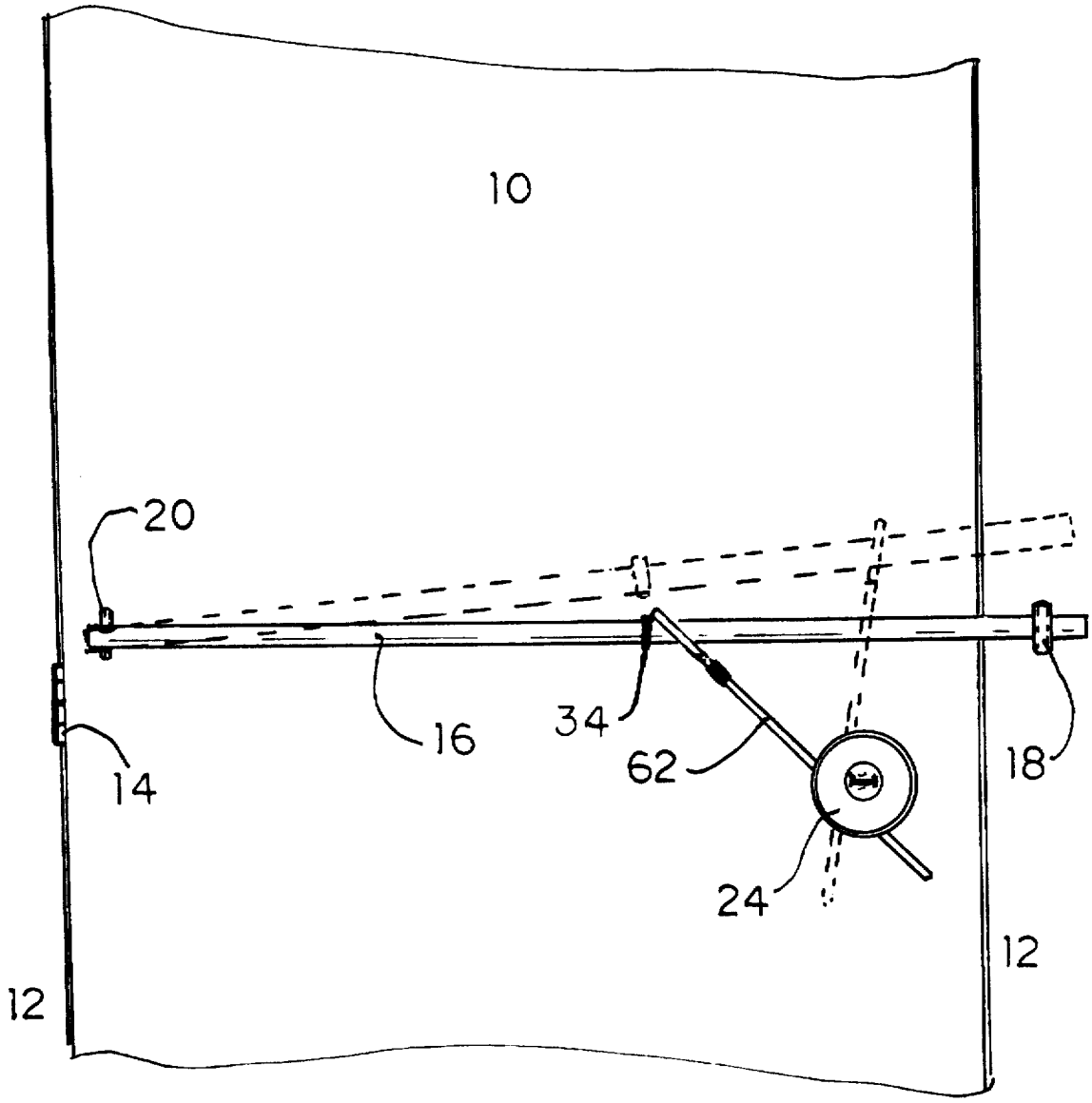
FIG. 9 shows a front operational view of an alternative embodiment of operating device assembly 62, disengaging a crossbar.
Figure 10:
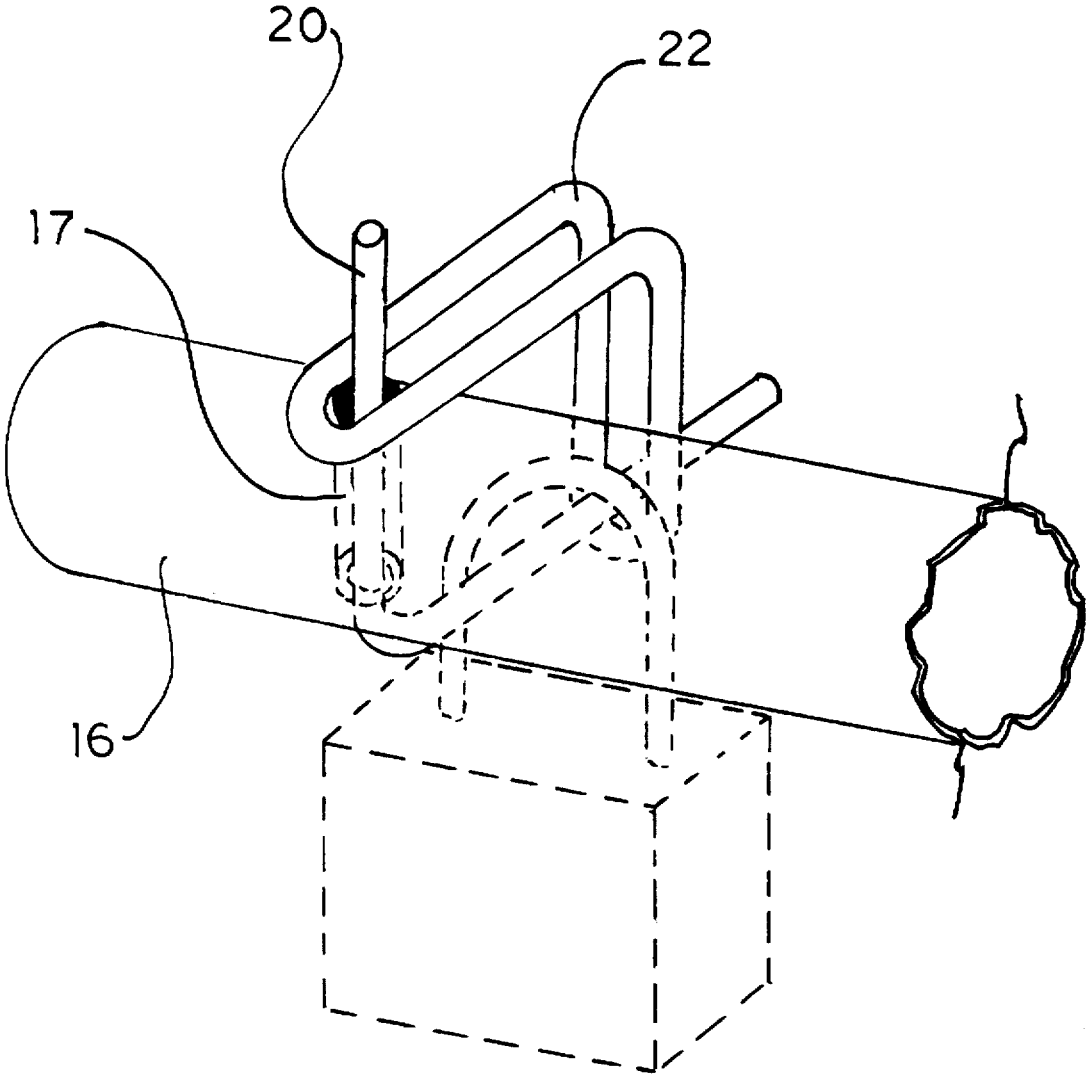
FIG. 10 illustrates the use of locking link 22 to hold the pivoting end of a cross bar in position.

Cross bar 16 is engaged on the hinge side of the door by means of oversized hole 17 received over minor screw hook 20 and the door knob end of the cross bar or bar is placed in the channel formed by major screw hook 18 and wall 12. Octagon block 26 is moved on the bar to overlie pressure plate 30 and is rotated on the bar such that one of the sides 29 of the octagon block is selected to lie against the plate. Proper side selection is accomplished when the distance between the plate and the block is minimum while not binding the block as it slides on the surface of the plate. Rotation of knob 24 rotates mechanism 60 which imparts an upward force against the bar as the engaging ring 50 pushes the bar upward when using the cam block operating assembly as shown in FIG. 8 or slides on the crossbar thus imparting upward thrust when using operating assembly 62 as shown in FIG. 9. The bar is not impeded from moving in this direction because hole 17 is substantially larger than screw hook 20. If the bar should stick during the raising motion the hinge side of the bar may be forced up. To prevent this, locking link 22 is engaged over the screw hook and the bar as shown in FIG. 1. This locking link may be locked in place by inserting the shackle of a common pad lock over the screw hook and under the locking link as shown in FIG. 10.

When the knob end of the bar has cleared the top of screw hook 18 and the knob has been rotated fully clockwise the door may be opened. Pushing the door closed with the bar in the raised position and rotating the knob counter clockwise will lower the bar into a latched position. If inclining ramp 31 is engaged on the major screw hook the knob need not be turned when engaging the mechanism. When using the operating device 62 embodiment, if the knob is rotated counter clockwise while the door is open, rubber washer 34 which is received snugly over bar 16 limits the travel of the bar and the operating device as shown in FIG. 9. Locking the knob by the key or a turn latch or such will prevent outside entry without a key or combination or such.

SUMMARY, RAMIFICATIONS, AND SCOPE

Accordingly, the reader will see that the security operating device is easily installed and allows several types of security devices to be to be operated in the most basic embodiment. It is unobtrusive in the exterior view of the property. Furthermore, the operating device has the additional advantages that:

it does not impart force to operate a device through a key;

it will hold the security device in operating position at all times, thus relieving the operator from handling the device;

it does not require a second key to enter the property;

it does not require removal of the doorknob for installation;

it does not require that the door be modified by adding a through hole for another lock set; and it is easily disengaged from the security device when the property is occupied.

Although the above description contains many specifications, these should not be considered as limiting the scope of the invention, but as mearly providing illustrations of some of the preferred embodiments of the invention. For example, the mechanisms shown describe lifting motions, whereas simple modification at the end of the shaft could easily provide pushing and pulling motions to engage a slide bolt or the like; the rubber washers 34 may be arranged on the cross bar such that there is both a lifting and sliding action if desired for a specific security device; and other modifications and variations may be made without departing from the invention.

Other alterations and modifications of the invention will likewise become apparent to those of ordinary skill in the art upon reading the present disclosure. Thus, the scope of the invention should be determined by the appended claims and their equivalents, rather than by the examples given.

I claim:

1. A security operating device, in combination with a locking doorknob with an exposed shank, and an auxiliary latching mechanism, consisting of a crossbar extending across a door and over a door jamb and pivoting on said door at one point and providing a positive, nonfrictional latch at another point, said security operating device comprising:

(a) a collar disposed around said exposed shank of said locking doorknob and affixed thereto with set screws for rotation therewith;

(b) a cam block attached to said collar;

(c) an actuator shaft received into said cam block and having an end extending outwardly therefrom; and (d) a ring connector on an opposing end of said actuator shaft receiving said crossbar therethrough which moves said crossbar into or out of positive latching engagement upon rotation of said locking doorknob, said ring connector defining an open portion of less than about 180°.

2. A security operating device as in claim 1 wherein said collar further comprises:

(a) a crescent portion greater than about 180° and defining an open portion less than about 180°, said collar, crescent portion, and open portion sized for fitting over said exposed doorknob shank without removing said locking doorknob; and (b) means for rigidly securing said collar to said exposed doorknob shank for rotation therewith.

3. A security operating device as in claim 2 wherein said means for rigidly securing said collar to said exposed doorknob shank comprises spaced apart fasteners attached to said collar with two of said fasteners spaced apart along said crescent portion more than about 180° and a third fastener interposed along said crescent portion between said two fasteners for releasably rigid contact with said exposed doorknob shank.

4. A security operating device as in claim 3 wherein said spaced apart fasteners comprise threaded set screws connected to said crescent portion through threaded holes for tightenable rigid contact with said exposed doorknob shank.

5. A security operating device as in claim 1 wherein said actuator shaft is secured to said collar with an adjustably selectable length extending outwardly from said exposed shank.

6. A security operating device as in claim 1 wherein said connector between said actuator shaft and said auxiliary latching mechanism is manually detachable from said actuator shaft only from inside said door.

7. A security operating device as in claim 1 wherein said auxiliary latching mechanism comprises a cross bar secured substantially horizontally across a door and pivotably attached on a minor hook at a hinged side of said door and with a major hook forming a cradle attached to a wall adjacent said locking doorknob side of said door, said collar, said actuator shaft and said connector attached between said exposed doorknob shank and said cross bar so that said cross bar is raised to a disengaged position when said locking doorknob is rotated to an open position and said cross bar is lowered to an auxiliary latched position when said door is closed and said locking doorknob is rotated to a closed door position.

8. A security operating device as in claim 7 wherein said connector further comprises a ring connector attached to said actuator shaft, which ring has an opening larger than said cross bar and fitted over said cross bar, such that rotation of said locking doorknob moves said actuator shaft and said ring connector attached therewith, with a vertical component of movement which raises or lowers said cross bar out of or into latching engagement.

9. A security operating device as in claim 8 wherein said ring connector is attached to said actuator shaft through a shaft adapter, which slidably engages between said ring connector and said actuator shaft, such that the normal downward weight of the cross bar holds said ring connector engaged with said actuator shaft, yet said ring may be detached from said actuator shaft through slidable movement of said shaft adapter against the weight of said cross bar.

10. A security operating device as in claim 9 further comprising a positioner frictionally engaged along said cross bar toward the hinged side of said cross bar, so that inadvertent sliding movement of said ring connector is prevented.

11. A security operating device as in claim 7 wherein said auxiliary latching cross bar further comprises a pressure block positionable over said cross bar, so that a portion of said pressure block is positioned between said cross bar and a surface of said door and so that said pressure block is positioned adjacent to said locking doorknob side of said door, such that slack between said cross bar and said door is reduced when said cross bar is engaged in said major screw hook.

12. A security operating device as in claim 7 further comprising a locking link holding said cross bar on said minor screw hook, said locking link including a bent metallic loop sized for fitting over said minor screw hook straddling said cross bar which is also positioned on said minor screw hook so that raising said cross bar from said minor screw hook is prevented by said locking link.

13. A security operating device as in claim 7 further comprising an inclining ramp on said major screw hook, said inclining ramp including a tube attached on one edge for fitting over said major screw hook, so that when said cross bar strikes said inclining ramp it will be raised over the top of said major screw hook and will drop into said cradle formed between said major screw hook and said wall.

14. A mechanism for retrofitting an existing keyed, bored, entrance lockset with an exposed shank, in combination with an auxiliary security latch, to operate said auxiliary security latch from outside a door to which said keyed, bored, entrance lockset is attached, comprising:

(a) a collar affixed with set screws to said exposed shank for rotation therewith;

(b) a cam block attached to said collar;

(c) an actuator shaft with one end received into said cam block and an opposing end extending outwardly therefrom; and (d) a detachable ring connector on an opposing end of said actuator shaft for attaching said auxiliary security latch to said actuator shaft, for movement of said auxiliary security latch into and out of latching engagement upon rotation of said exposed shank, said ring connector defining an open portion of less than about 180°.

15. A door security device comprising;

(a) a locking doorknob having an exposed shank which is rotatable when said locking doorknob is not locked and which is not rotatable when said locking doorknob is locked;

(b) an auxiliary latching mechanism, consisting of a crossbar extending across a door and over a door jamb and pivoting on said door at one point and providing a positive, nonfrictional latch at another point;

(c) a collar affixed with set screws to said exposed shank of said locking doorknob;

(d) a cam block affixed to said collar;

(e) an actuator shaft received into said cam block and extending outwardly therefrom, such that said actuator shaft moves with a linear component of motion upon rotation of said locking doorknob; and (f) a ring connector on an opposing end of said actuator shaft and receiving said crossbar therethrough, for movement of said crossbar into or out of latching engagement upon rotation of said locking doorknob, said ring connector defining an open portion of less than about 180°.

* * * * *